US006637860B1

(12) United States Patent
Madeley

(10) Patent No.: US 6,637,860 B1
(45) Date of Patent: Oct. 28, 2003

(54) HIGH THROUGHPUT INKJET PRINTER WITH PROVISION FOR SPOT COLOR PRINTING

(75) Inventor: James Madeley, North Vancouver (CA)

(73) Assignee: Creo Srl, Burnaby (CA)

( * ) Notice: Subject to any disclaimer, the term of this patent is extended or adjusted under 35 U.S.C. 154(b) by 0 days.

(21) Appl. No.: 10/142,860

(22) Filed: May 13, 2002

(51) Int. Cl.[7] ..... B41S 2/155
(52) U.S. Cl. ..... 347/42; 347/13; 347/43
(58) Field of Search ..... 347/42, 13, 40, 347/43, 15, 16

(56) References Cited

U.S. PATENT DOCUMENTS 4,630,076 A * 12/1986 Yoshimura ..... 347/43
5,408,746 A 4/1995 Thoman et al.
5,646,665 A 7/1997 Swanson et al.
6,234,605 B1 5/2001 Hilton
6,299,287 B1 * 10/2001 Williams et al. ..... 347/43

FOREIGN PATENT DOCUMENTS

WO WO 9634763 A1 11/1996

* cited by examiner

*Primary Examiner*—Lamson Nguyen
(74) *Attorney, Agent, or Firm*—Oyen Wiggs Green & Mutala

(57) ABSTRACT

An inkjet printer has an array of individual inkjet printheads to allow high-speed printing in standard process colors while also having additional nozzles that can be used to print spot colors. There are fewer inkjet nozzles allocated to each spot color than each of the process colors so that the printing speed for printed sheets containing spot colors may be less than for printed sheets only containing the process colors.

40 Claims, 5 Drawing Sheets

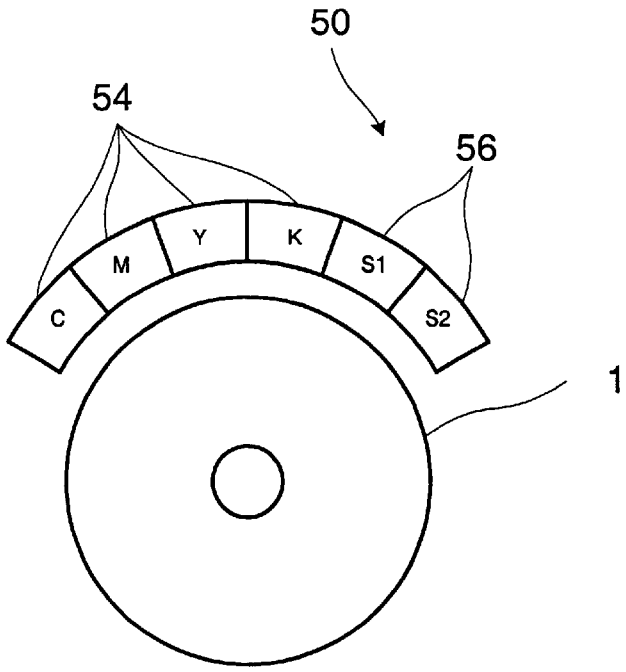
FIG. 5-A
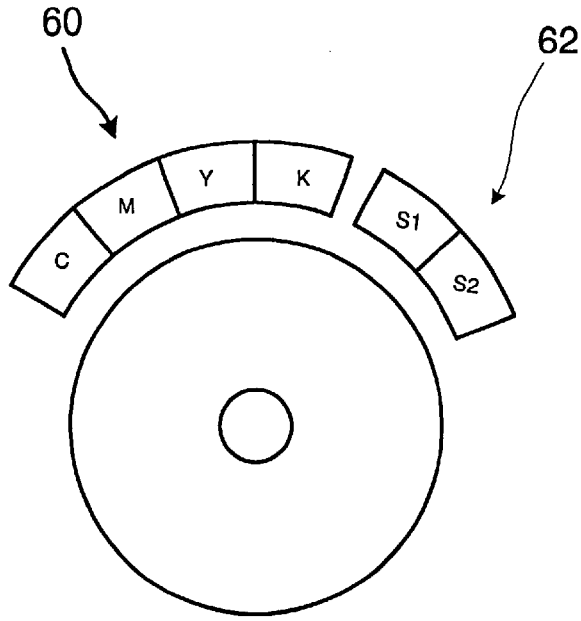
FIG. 5-B

HIGH THROUGHPUT INKJET PRINTER WITH PROVISION FOR SPOT COLOR PRINTING

CROSS-REFERENCES TO RELATED APPLICATIONS

This application is related to U.S. application Ser. No. 10/142866 entitled "High Throughput Inkjet Printing System" filed concurrently herewith.

FIELD OF THE INVENTION

The invention relates to the field of inkjet printing and more particularly to inkjet printing with additional spot colors.

BACKGROUND OF THE INVENTION

Inkjet printers produce images on a receiver by ejecting ink droplets onto the receiver in an imagewise fashion. The advantages of non-impact, low-noise, low process control requirements, low energy use, and low cost operation, in addition to the capability of the printer to print on plain paper and to readily allow changing the information to be printed, are largely responsible for the wide acceptance of ink jet printers in the marketplace.

Drop-on-demand and continuous stream inkjet printers, such as thermal, piezoelectric, acoustic, or phase change wax-based printers, have at least one printhead from which droplets of ink are directed towards a recording medium. Within the printhead, the ink is contained in one or more channels. By means of power pulses, droplets of ink are expelled as required from orifices or nozzles at the end of these channels. The mechanisms whereby ink ejection works in these various types of machines are well established and will not be further discussed in the present application for letters patent.

The inkjet printhead may be incorporated into a carriage type printer, a partial width array type printer, or a pagewidth type printer. The carriage type printer typically has a relatively small printhead containing the ink channels and nozzles. The printhead can be attached to a disposable ink supply cartridge as one piece, and the combined printhead and ink cartridge assembly is attached to a carriage. In other arrangements ink is supplied on a continuous basis to the printhead via a hose arrangement from an ink reservoir located away from the inkjet printhead. The carriage is reciprocated to print one swath of information (equal to the length of a column of nozzles in the paper advance direction) at a time on a recording medium, which is typically maintained in a stationary position during the reciprocation. After the swath is printed, the paper is stepped a distance equal to the width of the printed swath or a portion thereof, so that the next printed swath is contiguous or overlapping therewith. Overlapping is often employed to address a variety of undesirable inkjet printing artifacts that may be traced, for example, to nozzle performance. This procedure is repeated until the entire page is printed.

In contrast, the pagewidth printer includes a substantially stationary printhead having a length sufficient to print across one dimension of a sheet of recording medium at a time. The recording medium is moved past the page width printhead in a direction substantially perpendicular to the printhead length. In most cases, the separation between individual nozzles is greater than the required dot spacing on the media, and hence the media may be passed under the page width printhead more than once whilst translating the printhead.

By this method, printing may be done at the interstitial positions, thereby to cover the desired area of the media.

Clearly, an inkjet printer may have a printhead that extends partway across the medium to be printed upon. In such a case, the printer is known as a partial pagewidth printer. The printing medium has to be passed repeatedly under the printhead while the printhead translates laterally over a considerable distance to ensure that the appropriate area of the printing medium is ultimately addressed with ink.

While inkjet technology has found its way into the industrial environment, it has tended to be confined to specialty areas. These include printing variable data and graphics on plastic cards and tags as well as on ceramics, textiles and billboards. It is also used in the personalization of addressing for direct mail and, most importantly, in print proofing applications. The focus has clearly been on exploiting the abilities of inkjet technology as they pertain to direct digital printing of variable information and in areas where the more established printing technologies are not cost effective, such as very short run length printing jobs.

While inkjet technology has been driven strongly by consumer use of this technology, it has not yet substantially penetrated the high run length, low cost, high quality printing market. The demands and requirements of this are rather different from those of the consumer environment. In this particular industrial marketplace, the need for high throughput, quality of print and reliability at a low cost per page is particularly strong. The standards in this respect are set by other technologies such as offset A printing, gravure and flexography. Offset printing and gravure, in particular, have had the benefit of many decades and even centuries of development.

Inkjet printer technology, in contrast, is conceptually strongly based on the principles of other consumer products such as personal typewriter and the dot matrix computer printer. The typical consumer inkjet system therefore shares with the typewriter and the dot-matrix printer such aspects as stepped roller-and-carriage-based medium advance as well as replacement cartridge-based ink-media.

There is a clear need for addressing some key aspects of inkjet technology that limit the wider application of this technology in areas served by the more traditional and high throughput technologies of gravure, offset and flexography. A large body of work has been done, particularly in the case of so-called drop-on-demand inkjet printers, on making ever-higher nozzle-density inkjet printheads using ever more sophisticated technology. However, in order to make reliable industrial inkjet systems that can challenge the more established printing technologies, some of the key challenges reside elsewhere in the printer system.

In the case of an inkjet system employing state-of-the-art inkjet printheads, the ink needs to be of a type that matches the receiver media and have such properties as will keep it from clogging the inkjet nozzles. Ink supply, and the removal and management of the gas dissolved in such ink, is a subject of considerable concern in many high performance inkjet systems and many complex solutions are devoted to resolving this matter. However, these are mostly aimed at ink cartridge-based systems.

It has been demonstrated that, as long as they are supplied with de-gassed or de-aerated ink and their pulsing duty cycle is maintained at a high enough level, piezoelectric inkjet systems are quite reliable. These two issues are central to the design and manufacture of a high reliability inkjet printer aimed at competing with traditional low unit cost, high throughput printing presses. In such a system, a large number of individual printheads may be combined on an inkjet printhead assembly, numbers of sixty or more being projected. This represents a very large number of nozzles indeed, particularly in view of the increased density of inkjet nozzles on printheads used in many recent products, each nozzle having a statistical probability of failure. The two issues of duty cycle and ink de-gassing are therefore exacerbated to a great degree by this form of implementation.

Provided these two issues are adequately addressed, piezoelectric inkjet ejection systems form the preferred technological platform for such inkjet systems. Unfortunately piezoelectric inkjet heads, in particular, are very susceptible to ink ejection failure when supplied with aerated inks. This stems from the fact that they operate on the basis of creating a pressure pulse within a small body of ink. The presence of gas or air within that body of ink totally disturbs the execution of this pressure pulse. It is therefore of critical importance to ensure that an adequate supply of de-gassed ink is supplied to the nozzles at all times during printing. The general principles of de-aeration or de-gassing of inkjet ink are well-known to those skilled in the art of inkjet technology. They will therefore not be presented here again.

The second issue, being that of duty cycle, should also not be underestimated. The reliability of all inkjet systems hinges strongly on the ability of individual nozzles to produce consistently ejected droplets in repetitive fashion. Prolonged periods of non-use of a given nozzle therefore constitute an invitation to failure through the nozzle clogging with drying or dried ink. Great effort has therefore been expended in the field of inkjet technology on the matter of maintenance systems for inkjet printers. One of the primary maintenance functions is that of capping the individual printhead when it is not in use. However, it is not generally practicable to cap just a fraction of the diminutive nozzles on a given individual printhead. For this reason it is important to maintain a minimum duty cycle on any given nozzle on an individual printhead, prevention being better than cure. The entire individual printhead is then capped when not in use.

The inkjet printer therefore ejects ink as regularly as possible from each inkjet nozzle without unnecessarily wasting ink. This firing rate, combined with the large number of nozzles, creates a consumption rate of ink that exceeds by far that which may be maintained through the manual replacement of exhausted de-gassed ink containers. This adds to the requirement for ink de-gassing to occur in-line as part of the operation of the inkjet printer.

Another shortcoming of prior art inkjet printers applied to industrial printing situations, is the difficulty in handling color. High quality printing is usually not in the capability of a 4 color Cyan (C), Magenta (M), Yellow (Y), and Black (K) printer since it will not provide the color gamut required to render images in accurate color. The first steps that are usually taken to address this problem is to supplement the CMYK colors (commonly referred to as process colors) with additional colors to improve image rendition. One common scheme makes use of the standard CMYK set with additional lower concentration Magenta and Cyan in order to improve the appearance of highlights that look grainy when printed with full concentration inks. Highlights are lightest or whitest areas of a halftone reproduction, having the lowest density of dots. The addition of Orange and Green is often used to improve flesh-tones while adding the primary colors of Red, Green, and Blue also improves the color gamut of the printing device.

While the approach of using these extended color schemes works relatively well in the consumer market environment, as well as certain specific industrial applications, there is a clear need for inkjet printers to be able to print specialty colors, also known as "spot colors", on a commercially viable basis. Parties familiar with established printing technologies, such as offset lithographic printing, gravure, and flexography, appreciate that commercial printing relies on the ability to do spot colors for many aspects of printing. The printing of trademarked logos, for example, very often employs very accurately specified colors. It is very often true that the standard process colors, even if augmented with colors to increase the general color gamut as described earlier, simply cannot accurately match a particularly specified color. In commercial printing, it is usual to specially formulate a particular ink that exactly matches a logo color for printing of corporate brochures and other printing work. Furthermore, special printing effects such as fluorescent and metallic colors are not reproducible with any of the standard inksets and obviously necessitate the use of spot colors.

In published patent application, WO9634763A1 an inkjet printer that increases the number of print colors available is disclosed. This device is equipped with five or more receiving stalls so that one or more specialized or spot colors can be incorporated, in addition to the usual CMYK colors, while the speed and quality of the printing operation is not affected. The specific device embodiment shown is a carriage inkjet printer with a conventional architecture. The disclosure is specifically addressed at introducing spot colors without adversely affecting printing speed or quality. Additionally, carriage inkjet printers with as many as twelve slots for various color cartridges are now available. These printers allow the user flexibility in selecting inksets or adding spot colors.

In page-wide inkjet printers, by partially or completely dispensing with the reciprocating carriage motion, very high throughput devices can be constructed that have productivity approaching that of conventional lithographic printing systems. By nature, since these devices are intended to compete with established commercial printing techniques, it is necessary to enable the use of spot colors to provide a competitive product. Incorporating spot colors in a page-wide device represents a significant logistical challenge in that the page-wide array comprises a multiplicity of printheads of each color and adding one or more spot colors significantly increases the number of printheads. Setting up and replenishing a page-wide spot color printhead with multiple cartridges would be an extremely tedious processes and changing spot colors from job to job under these circumstances is impractical. Similarly accommodating a large number of spot colors is also impractical due to space constraints, connectivity, and other logistical considerations. Clearly, methods of dealing with the problems encountered in providing a workable spot-color handling solution for a high productivity page-wide or partial page-wide inkjet printer are lacking.

It is an objective of the present invention to provide a method and apparatus to allow page-wide inkjet printing on a commercially practicable basis employing spot colors.

SUMMARY

The present invention is described in reference to a high-throughput inkjet printing device capable of printing process colors and optionally printing spot colors. The printing device is equipped with one or more spot color printheads that can accommodate one or more spot colors for extending the general color gamut and/or printing specially mixed spot color inks. There are less inkjet nozzles provided for each spot color than for each process color. Pages with spot colors are printed either at full resolution and a reduced printing rate, or the spot colors are printed at full print rate at reduced resolution.

BRIEF DESCRIPTION OF THE DRAWINGS

FIGS. 5-A and 5-B are side views of embodiments of the present invention showing a possible layout of the printhead assemblies.

DESCRIPTION OF PREFERRED EMBODIMENTS

Figure 1:
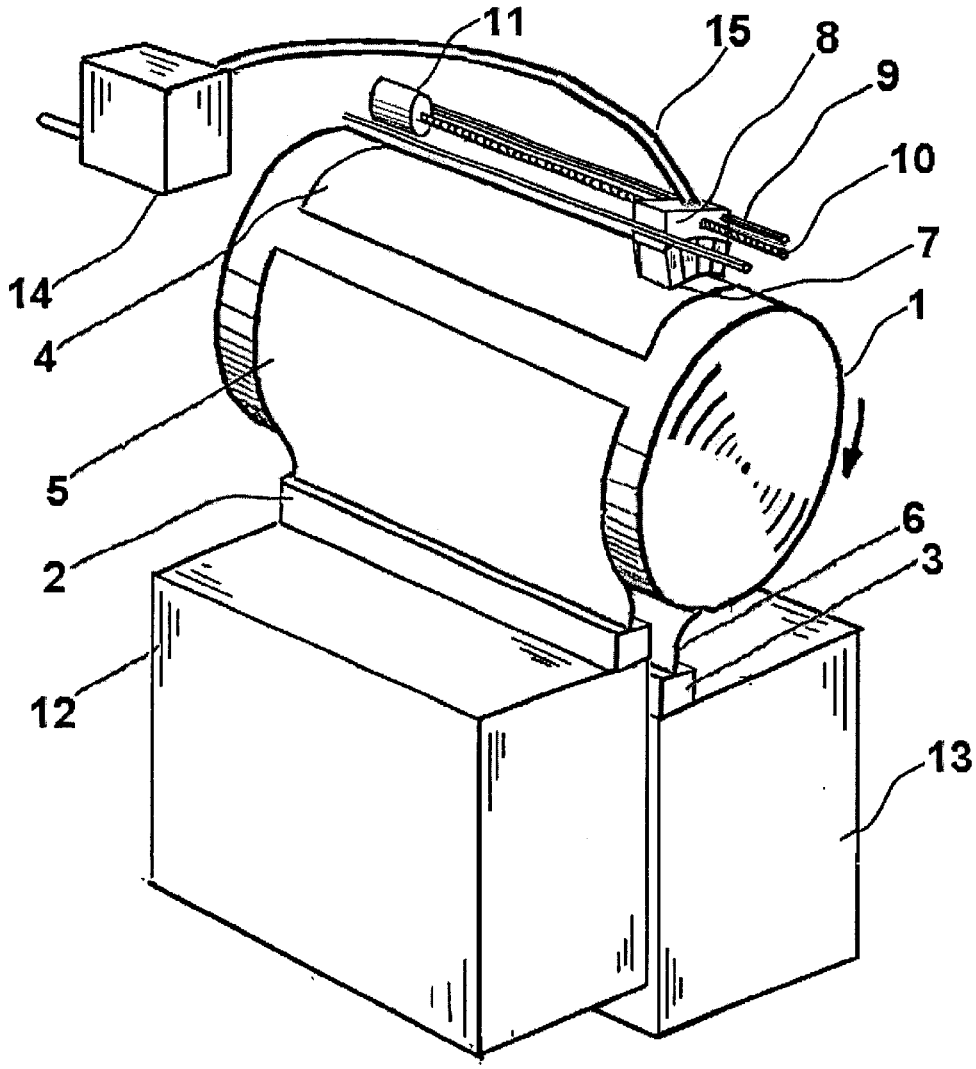
FIG. 1 shows the inkjet printer of a preferred embodiment of the present invention.

FIG. 1 shows a first preferred embodiment of the present invention in the form of a cylinder based inkjet printer with a partial pagewidth inkjet printhead assembly. The term inkjet printhead assembly is used in the present application for letters patent to describe an inkjet printer head assembly that is comprised of one or more individual printheads. The term individual printhead is used in this application for letters patent to describe an array of one or more inkjet nozzles, typically fashioned as a integrated unit, having a single nozzle substrate, and served with ink either from an ink reservoir located within the integrated printhead unit, or via a hose system from an ink reservoir separately located. Many commercial versions of such individual printheads are known and these may be combined by various methods to create an inkjet printhead assembly, some of these being described, for example, in U.S. Pat. No. 5,646,665 and U.S. Pat. No. 5,408,746 and in our co-owned, co-pending U.S. patent application Ser. No. 09/922,150. To the extent that the various designs for individual printheads are well known in the field, they will not be further described here, nor will the methods of combining them into inkjet printhead assemblies. The term partial pagewidth inkjet printhead assembly is used in this application for letters patent to describe an inkjet printhead assembly that may consist of one or more arrayed individual printheads, but which does not extend across the entire width of the widest media that the machine will print on.

In the particular case of the preferred embodiment shown in FIG. 1, the printing media carrier 1 is a printing cylinder, capable of carrying paper or other sheet-like printing media. In this application for letters patent, the term receiver medium is used to describe the printing media on which printing is to take place. This printing media may be of different sizes, textures and composition. In the preferred embodiment of the present invention, receiver medium load unit 2 and receiver medium unload unit 3 respectively load and unload sheets of receiver medium onto and from printing media carrier 1. Advantageously these sheets of receiver medium may be held on printing media carrier 1 by any of a variety of methods, including, but not limited to, suitable vacuum, applied through holes in printing media carrier 1, or via static electrical charge applied to printing media carrier 1 and/or to the sheets of receiver medium. These holding mechanisms are well known to those skilled in the art and will not be discussed any further in the present application for letters patent.

In FIG. 1 three sheets of receiver medium are shown. Sheet 4 of receiver medium is shown in a position where printing is taking place. Sheet 5 of receiver medium is shown being loaded onto printing media carrier 1 by receiver medium load unit 2. Sheet 6 of receiver medium is shown being unloaded by receiver medium unload unit 3. Advantageously, receiver medium loading unit 2 and receiver medium unload unit 3 can load and unload different sizes, formats, textures and compositions of sheets of receiver medium.

Inkjet printhead assembly 7 is mounted on printhead assembly carriage 8, which moves on linear track 9. Linear track 9 is arranged substantially parallel to the rotational axis of printing media carrier 1 and at such a distance as to allow inkjet printing by the standard inkjet processes known to practitioners in the field. Printhead assembly carriage 8 is translated along the width of printing media carrier 1 by the action of lead screw 10 and engine 11. A variety of other simple controlled translation mechanisms are also known in the art, and may alternatively be employed for the purposes of moving printhead assembly carriage 8 in controlled fashion.

Sheet supply unit 12 contains a supply of sheets of receiver medium to be loaded by receiver medium load unit 2. Receiver medium unload unit 3 places sheets of receiver medium that it has unloaded from printing media carrier 1 into sheet collector unit 13. Various formats of sheet supply units and sheet collector units are well known to practitioners in the field and will not be further discussed in the present application for letters patent. The term loading, as pertains to a sheet of receiver medium, is used in this application for letters patent to describe the entire procedure of placing the receiver medium onto a printing media carrier, from initial contact between said sheet of receiver medium and the printing media carrier, to the sheet of receiver medium being fully and completely held onto the printing media carrier. The term unloading, as pertains to a sheet of receiver medium, is used in this application for letters patent to describe the entire procedure of removing the receiver medium from a printing media carrier, from full contact between the sheet of receiver medium and the printing media carrier, to the sheet of receiver medium being fully and completely removed from the printing media carrier.

In FIG. 1 ink de-gassing unit 14 supplies de-gassed ink to inkjet printhead assembly 7 via de-gassed ink supply conduit 15. In the case where inkjet printhead assembly 7 employs more than one color of ink, ink de-gassing unit 14 has more than one ink de-gassing line to provide the different inks along separate de-gassed ink supply conduits to the various individual printheads on inkjet printhead assembly 7. In the preferred embodiment shown in FIG. 1, the fluid being deposited is ink. In a more general case other fluids may be de-gassed and deposited including, but not limited to, polymers (specifically including UV cross-linkable polymers), solders, proteins and adhesives. The term in-line de-gassing is used in the present application for letters patent to describe the continuous, intermittent, controlled or scheduled de-gassing of ink that occurs while de-gassing unit 14 is connected to the rest of the inkjet printing system by at least de-gassed ink supply conduit 15. Further mechanical, communications and electrical interconnections may be employed between de-gassing unit 14 and the rest of the inkjet printing system. The term, as used here, allows for the ink-de-gassing to be non-continuous, and to be conducted only as and when demanded by the rest of the inkjet printing system or according to a schedule based on the printing throughput of the inkjet printing system. The term, as used here, specifically excludes the de-gassing of ink at a different site from that of the rest of the inkjet printing system, followed by transport in a vessel to the inkjet printing system. In this latter situation, there is no in-line aspect to the de-gassing of the ink.

A further refinement of the present invention includes a de-gassing control unit (not shown) designed to provide the required supply of de-gassed fluid based on actual fluid usage, which can be expressed in terms of volume or rate or both. The volume is determined by one or more of:

1. the quantity of sheets of receiver medium loaded onto printing media carrier 1 by receiver medium load unit 2 and the quantity of fluid required per sheet,
2. the quantity of sheets of receiver medium unloaded from printing media carrier 1 by receiver medium unload unit 3 and the quantity of fluid required per sheet
3. the total quantity of ejected droplets of the fluid from all printheads of the inkjet printing system.

The rate is determined by at one or more of:

1. the rate at which sheets of receiver medium are loaded onto printing media carrier 1 by receiver medium load unit 2 and the quantity of fluid required per sheet
2. the rate of unloading of sheets of receiver medium from printing media carrier 1 by receiver medium unload unit 3 and the quantity of fluid required per sheet,
3. the total rate of ejecting of droplets of fluid from all printheads of the inkjet printing system.

In the first preferred embodiment, as shown in FIG. 1, inkjet printhead assembly 7 is shown as a partial page width inkjet printhead assembly comprising four individual printheads having only one individual printhead per row substantially parallel to the rotational axis of printing media carrier 1. These printheads may be, by way of example, four different individual printheads for the industry standard Cyan, Magenta, Yellow, and Black colors. In a more general embodiment, there is no limitation on the choice of individual printheads, or their combination. For example, individual printheads of differing nozzle density or different nozzle count or different color may be employed.

Figure 2:
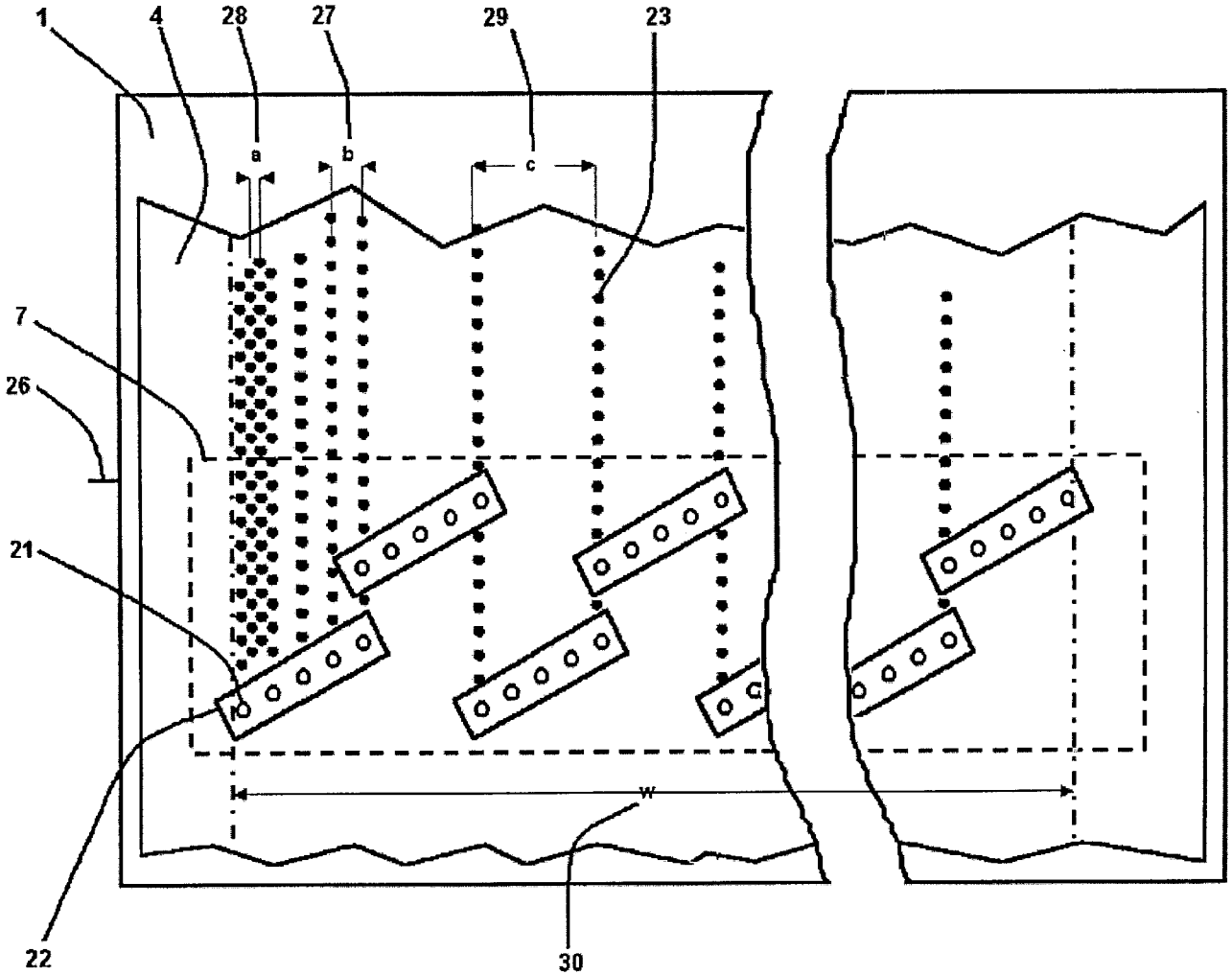
FIG. 2 shows the relationship between an inkjet printhead assembly and the media printed upon.

FIG. 2 shows the relationship between inkjet printhead assembly 7, printing media carrier 1 and sheet 4 of receiver medium in more detail. Inkjet printhead assembly 7 has a plurality of individual printheads 22 arranged in rows substantially parallel to the rotational axis of a printing media carrier 1. There may be more than one such row of individual printheads. The individual printheads in adjoining rows may also be staggered in their layout and/or rotated with respect to the rotational axis 26 of printing media carrier 1. The need for staggering arises from practical consideration of the bulk of the individual printheads 22, which limits their placement. In such an arrangement inkjet printhead assembly 7, therefore, comprises an array of individual printheads that may extend in one or more directions.

In FIG. 2 inkjet nozzles 21 of individual printheads 22 place inkjet dot tracks 23 on sheet 4 of receiver medium by depositing dots of a fluid, which may be, but is not limited to, an ink. Any particular inkjet dot tracks 23 may either have dots at particular points, or not have dots at those points, depending on the data sent to the inkjet nozzle addressing the inkjet dot track at that point. For the sake of clarity, only a segment of sheet 4 of receiver medium is shown and, for the same reason, only a limited number of inkjet dot tracks 23 are shown. Individual printheads 22 are arrayed on inkjet printhead assembly 7 as a staggered array, with each individual printhead 22 rotated at some angle with respect to the rotational axis 26 of printing media carrier 1 bearing sheet 4 of receiver medium on its cylindrical surface. Inkjet nozzles 21 have a nozzle separation 27, denoted by symbol b, measured along rotational axis 26. Nozzle separation 27 is an integer multiple n of the minimum desired inkjet dot track spacing 28, denoted by symbol a, and is measured along rotational axis 26. In FIG. 2 five inkjet nozzles 21 are shown per individual printhead 22. This is done for the sake of clarity. In a practical inkjet printing system, there may be hundreds of inkjet nozzles 21 per printhead 22, and they may be arranged in multiple rows. In the general case of this embodiment of the present invention, individual printheads all have an integer number N of inkjet nozzles 21.

During one rotation of printing media carrier 1 an individual printhead 22 prints a swath of width (N−1)b on sheet 4 of receiver medium. This swath is composed of N tracks, with adjacent inkjet dot tracks 23 separated by a distance b. In order to obtain a greater density of dot tracks 23, the same or another individual printhead has to traverse the same section of sheet 4 of receiver medium during a subsequent scan which may take place at a different time or after an intentional delay to allow inkjet dot tracks 23 to dry.

In the general case, some of the inkjet dot tracks 23 of different individual printheads 22 may coincide as shown in FIG. 2. This is done to address printing artifacts that may arise due to slight misalignments of adjacent individual printheads 22. Where more than one inkjet nozzle 21 addresses an inkjet dot track 23, the two inkjet nozzles 21 may be instructed to address the inkjet dot track 23 alternately in order to interleave the inkjet dot track 23 and to thereby diminish repetitive misalignment artifacts that become visible when printing proceeds over large areas of sheet 4 of receiver medium.

In order to obtain the benefits of such interleaving, and/or to ensure that different inkjet drop tracks 23 correctly align during consecutive or subsequent rotations, adjacent individual printheads 22 are arranged such that they are offset from each other along rotational axis 26 by an inter-head separation 29, denoted by symbol c. This inter-head separation 29 is chosen to be an integer multiple m of nozzle separation b such that c=mb.

Inkjet printhead assembly 7 may be translated or advanced along rotational axis 26 with a pitch p, the distance that printhead assembly 7 travels in one rotation of printing media carrier 1. This pitch p is chosen such as to allow inkjet dot tracks 23 to interlace by any of a wide variety of interlacing schemes known to those practiced in the art of ink jet technology. Many such interlacing schemes, each having different benefits and drawbacks, exist and will not be discussed any further in the present is application for letters patent.

To obtain a greater number of inkjet dot tracks 23 within the swath printed by an individual printhead 22, printing media carrier 1 has to be rotated a further number of times and inkjet printhead assembly 7 must be advanced along rotational axis 26 at the appropriate pitch. In the particular case where the pitch p=Kb+a (wherein K is 0 or a positive integer), printing media carrier 1 may be rotated b/a times to produce a printed swath with inkjet dot tracks 23 that are separated by the minimum desired inkjet dot spacing a.

In an alternative scanning arrangement, inkjet printhead assembly 7 is not advanced along rotational axis 26 continuously with a pitch p, but, rather, completes a scan around the entire circumference of printing media carrier 1 and is then stepped a distance p in the direction of the rotational axis 26. This approach causes fully circular inkjet dot tracks 23 to be printed, rather than spirals.

In the present application for letters patent, the term pagewidth inkjet printer is used to describe in particular the special case where inkjet printhead assembly 7 contains a large enough integer number M of individual printheads such that one rotation of printing media carrier 1 causes substantially the entire desired printing area of sheet 4 of receiver medium to be addressed by inkjet nozzles 21 writing inkjet dot tracks 23 of spacing b. In FIG. 2 the desired printing area of receiver media 4 is shown as having desired printing width 30, denoted by symbol w. In this process each individual printhead 21 prints a swath of width (N−1)b, and these swaths may overlap by some number of inkjet dot tracks 23. For the sake of clarity, only the two axial ends of the entire arrangement are shown in FIG. 2.

In the example given in FIG. 2, each such swath overlaps by one inkjet dot track with the swath produced by an adjacent individual printhead. It is to be noted that such a single rotation does not necessarily produce inkjet dot tracks 23 of the minimum desired inkjet dot track spacing a. Further rotations of printing media carrier 1 are required to obtain higher inkjet dot track densities. In that process inkjet printhead assembly 7 may be either advanced continuously along rotational axis 26 to create inkjet dot tracks 23 that are spirals, or may be advanced along rotational axis 26 in one step at the end of each rotation to create circular inkjet dot tracks 23. In a carriage inkjet printer, the printhead assembly must travel across the entire page to achieve full coverage of the page. By contrast, the amount of travel for a page-wide array is only the amount required to achieve the desired resolution. In a partial page-wide printer, the amount of travel required to achieve the desired coverage and resolution depends on the actual printhead configuration and falls somewhere in-between the two aforementioned cases. There may be multiple staggered arrays of individual inkjet heads on inkjet printhead assembly 7. Each such array may be dedicated to a different color in an industry standard color set.

In yet a further embodiment of the present invention, the nozzle arrangements for the different staggered arrays need not be identical. In this embodiment there is no limitation on the number of individual printheads, the combination of printed colors from the individual printheads, or other properties of the individual printheads. For example, individual printheads having different number of nozzles or different nozzle density may be employed in arrays extending in more than one direction. This would be done to allow different colors, different combinations of colors, different ink drop sizes, different ink compositions, and/or different resolutions to be printed using fewer total number of individual printheads. Furthermore, while the choice of piezoelectric ejection is preferred for its generically superior performance characteristics, the present invention applies also to in other inkjet systems such as thermal and continuous inkjets.

As may be readily understood, the large number of individual printheads involved in each of these additional embodiments of the present invention, combined with the need for a certain minimum duty cycle of ink ejection from each nozzle, necessitates a high throughput of receiver medium and in-line ink-degassing. These two items represent the primary consumables of such an automated system and their consumption must be balanced whilst the operating parameters of the inkjet nozzles are maintained in the interest of low failure rate.

With the loading, unloading and printing of sheets of receiver medium being integrated in the fashion described herewith, the receiver medium path of the invention is optimized for throughput. In fact, there may be more than one sheet of receiver medium present on printing media carrier 1 and ready to be printed upon while another is being loaded and yet another unloaded, all at the same time. This allows the total automation of the media handling system of the inkjet printing system of the present invention. This represents an approach that is well suited to the press environment and well understood in commercial environments where throughput is critical.

All of the above throughput advantages, however, are as naught, if the printer has to be interrupted for the purposes of supplying another container of off-line de-gassed ink. Commercially such ink is supplied in relatively small quantities that are insufficient to the throughput needs of the inkjet printer described in the preferred embodiment of the present invention. Within industry, these quantities are intentionally kept comparatively small in order to minimize the re-aeration of the ink. With reference to FIG. 1 the incorporation of an ink de-gassing unit 14 to provide in-line de-gassed ink as an integral part of the inkjet printing system, allows the ink needs and the receiver medium needs of the printer to be balanced so as to optimise the overall throughput, not allowing either of these critical aspects to become a process bottleneck.

In the case of a high throughput inkjet system, the combination of receiver media loading/unloading whilst the cylinder is rotating at speed, and optionally printing at the same time, combined with an in-line supply of de-gassed ink to a high throughput printhead represents a key systems aspect. It is this very combination that allows the present invention to make the transition from being purely another inkjet printing machine to a machine that viably addresses the needs of the volume industrial printing industry.

The present invention provides some of the advantages of a direct-to-press, or digital-on-press (DOP) offset, printing press. With a DOP offset press, the data to be printed is permanently applied to a printing plate, which is then operated to print at very high speed with the ink being supplied substantially continuously. While the present invention allows for printing speeds that are still slower than offset printing, it has the major advantage of not requiring any printing plates whilst allowing high-resolution image data to be changed with great ease. This is ideal for shorter run printing.

The provision of one or more spot colors could be achieved in the same manner by just adding additional rows of individual printheads. However, as previously mentioned, the logistics of changing a very large number of removable individual printheads or changing ink supply to a large number of fixed individual printheads is not practical. The term "process color" is used to refer to the commonly used CMYK inksets used to produce color print representations along with extensions to the process color set used to improve color representation or color gamut of the printer. An example is Hexachrome® developed by Pantone, Inc. In the Hexachrome color set, the existing CMYK primary inks have been modified and orange and green inks have been added. Hexachrome is capable of accurately reproducing over 90% of the Pantone Matching System® Colors (PMS). Pantone's PMS is an international reference for selecting, specifying, matching and controlling ink colors, widely used in printing. The inclusion additional colors to extend the color gamut is often referred to as HiFi color and the screening and color separation process is modified so that colors are made up of combinations of six colors rather than the usual four color CMYK. Such HiFi color sets are taken to be included in the term "process colors".

In this application and the appended claims, the term "spot color" is used to refer to any color that is not a process color. Spot colors are used in printing to provide a specific color shade for a specific job. This may involve providing specially chosen color ink that is used to print a localized specific area of a printed sheet. In the area where this ink is printed, generally only this single color is used and not a combination of a number of colors. While the density of the printing may be varied, the single color, having been chosen to match certain criteria, is not further modified or overprinted by the process colors. In many instances, the spot color is localized to only certain areas of a print. Examples of this would be a corporate logo appearing in a fixed position on a page or an area of metallic, fluorescent, or some other specialized color. Alternatively a spot color may be used to provide a more accurate match for specific colors than can be provided by the process color set, either basic or extended "hi-fi" color. In this case, the spot color may be combined with other colors according to a screening algorithm.

In printing process color, it is common to have the same number of nozzles for each of the cyan, magenta and yellow colors. In printers that are targeted to print a lot of black, such as primarily text based documents, it is also quite common to increase the number of nozzles used for black. The purpose for increasing the number of nozzles may be twofold: Firstly, pages with only black text or black & white graphics can be printed at higher speed than pages containing colors. Secondly, along with the additional nozzles a greater total ink reservoir capacity can be provided for black thus extending the time between required refilling or changing the black ink supply. Alternatively, the black color may be printed with the same number of nozzles but the reservoir capacity may be increased. In this case a printing rate benefit in not realized, only an extension of the ink supply capacity.

In order to address the matter of spot colors, the present invention dedicates at least one additional array of individual printheads for the provision of spot colors. In the present invention, the number of printheads for each spot color is reduced by some factor over the number printheads for each of the standard process colors thus reducing the cost and complexity of implementing and maintaining spot colors on a high throughput inkjet printer. Spot colors can be printed at full resolution with lower throughput, or the resolution can be reduced to maintain throughput. In some instances, depending on the image to be printed, the spot color may also be applied without any penalty in resolution or speed.

Figure 3:
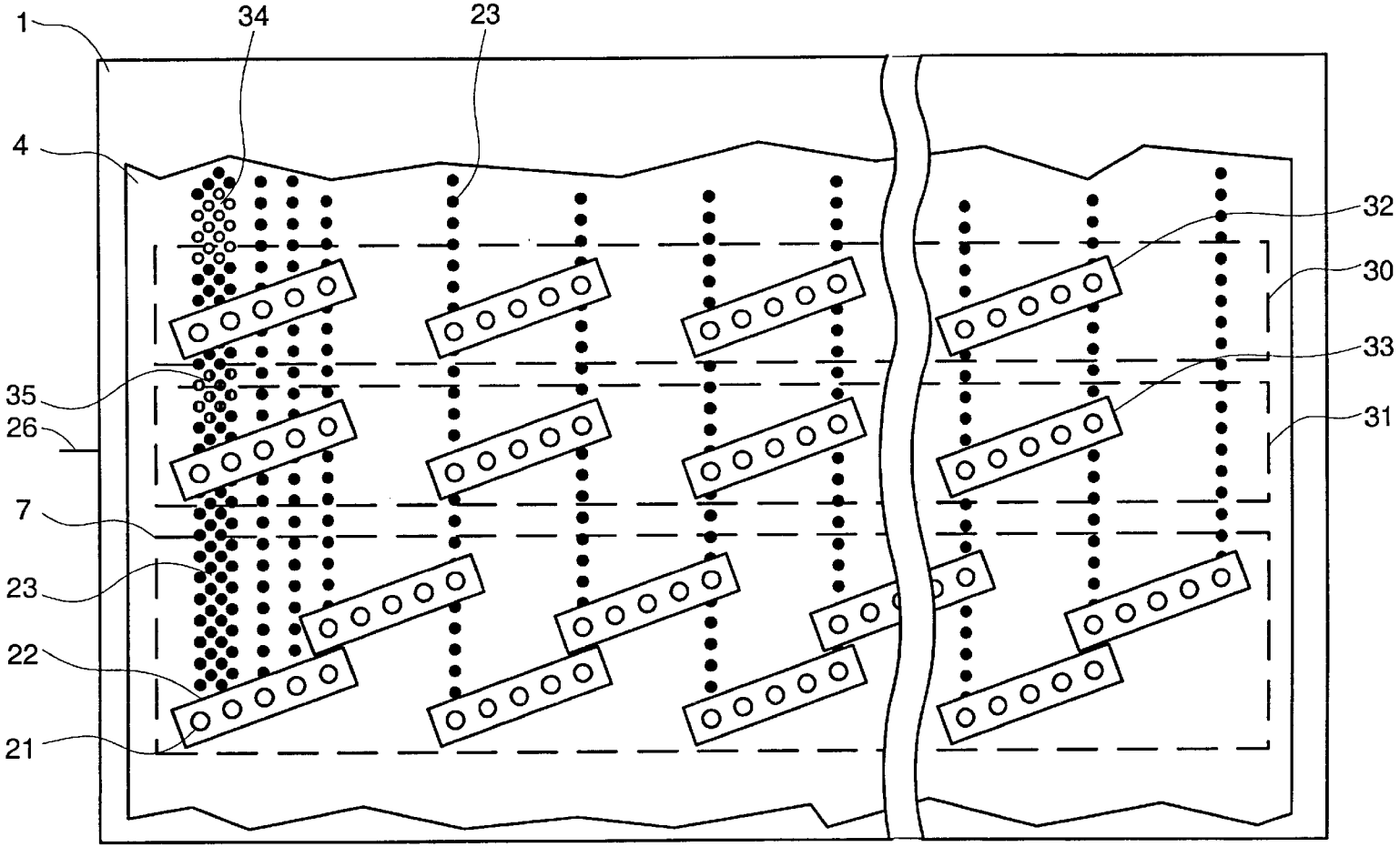
FIG. 3 shows an embodiment of a page-wide inkjet printer with spot color printheads.

In an embodiment shown in FIG. 3, the inkjet printhead assembly 7 of FIG. 2 is supplemented by a pair of spot color printhead assemblies 30 and 31. Spot color printhead assemblies 30 and 31 are made up of an array of individual printheads 32 and 33 respectively, the arrays being more sparsely populated than for the process color printhead assembly 7. In the specific embodiment shown in FIG. 3, the spot color printhead assemblies are populated with half the number of individual printheads compared to printhead assembly 7 although other combination ratios are also possible. Printhead assemblies 30, 31 and 7 may share a common advance mechanism providing an extended range of advance to be able to print in the areas between adjacent individual printheads. The standard process colors printed by printhead assembly 7 are shown as dots 23 while spot colors are shown as dots 34 and 35 are printed by printhead assembly 30 or 31. Depending on the application spot colors may be printed as solid areas or screened to provide a density less than the solid print density. Alternatively, in the case where the spot colors are intended to increase the general color gamut the dots may be dispersed with the process colors according to the screening process in use.

Figure 4:
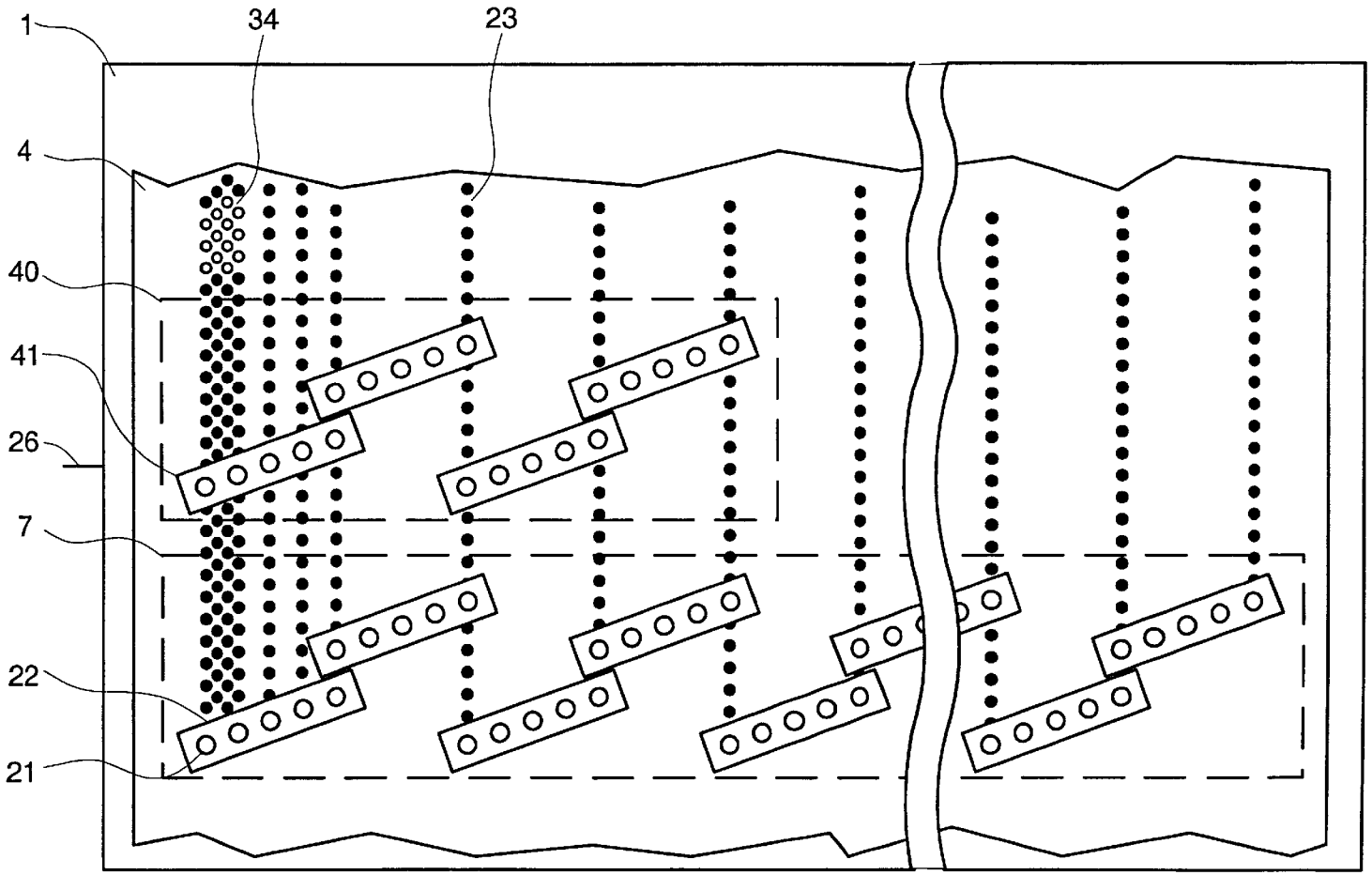
FIG. 4 shows an alternative embodiment of a page-wide inkjet printer with partial page-wide spot color printheads.

In another embodiment shown in FIG. 4, the inkjet printer is equipped with one or more spot color printhead assemblies 40. In this case, the printhead assembly is only the width of a portion of the receiver medium 4. Printhead assembly 40 has less individual printheads 41 than the standard process color printhead assemblies. In this embodiment, the carriage advance for spot color printhead 40 may be provided separately to the advance for printhead assembly 7. This is advantageous in a case where the spot color occupies only a portion of the printed page the spot color carriage simply advances to this position and prints the spot color. The process colors are then printed normally at full printing rate and depending on how many less nozzles are provided for the spot color, the spot colors may or may not be printed at full throughput. As with any inkjet printing operation it is necessary to take account of how ink dots are laid down to achieve good printing results. Drying time and mixing between adjacent dots is usually accounted for by carefully controlling the sequence of laying down the dots of each color.

For the embodiments shown in both FIG. 3 and FIG. 4 the fact that there are less inkjet nozzles for each spot color than for each process color indicates that some trade off must be made. One possible trade off is to reduce the process color printing rate to match the spot color printing rate for pages that have spot color regions. In this case, the spot colors can be printed at full resolution albeit at a reduced rate compared to pages that have no spot color regions. Pages that do not contain spot color can still be printed at full process color printing rate. In this application for letters patent, the term "printing rate" is used to describe the speed at which a given print area will be fully addressed by a printhead assembly of a particular color.

Alternatively, the spot colors can be configured to produce larger dot areas in proportion to the ratio of the number of process color nozzles to spot color nozzles. The spot colors then print at the same rate but lower resolution without leaving uncovered receiver medium between the further spaced dots. The area of coverage of an inkjet dot on the receiver medium can be increased by simply jetting a larger fluid volume per dot or by using a different ink constitution that spreads or wets differently or a combination thereof. The resolution trade off is a reasonable one since colored text printed in process color often exhibits jagged outline caused by the rosettes of the colors required to make a particular shade. If text is printed with a specially chosen spot color, then this problem is largely avoided and it is possible to get good or even better quality from spot color printing at a lower resolution than for a corresponding process color at full resolution. As an example the process colors may be printed at a first high resolution while the spot colors are printed at half the process color resolution but with an inkjet nozzle droplet volume larger than that of the process color nozzles. The spot color nozzles would thus cover the full width of the page with half the resolution and half the number of nozzles with no sacrifice in printer throughput.

While the above embodiments have been outlined with reference to a particular architecture of inkjet printer that uses a cylinder to transport the media past the printheads, the embodiments related to the provision of spot colors in a partial page-wide or page-wide printer apply equally well to other architectures. Printers that use page-wide printheads can also be constructed with various well-known media feed mechanisms that accomplish a similar function. While a cylinder type printer is particularly suited to accommodating a large number of individual printheads around its periphery the application of the present is not limited to this particular case and a flatbed inkjet printer may be advantageous, particularly in printing on a rigid receiver medium. A flatbed printer commonly holds the media on a flat platen and relative motion is generated in one or more axes between the printheads and the receiver medium. Alternatively, that receiver medium can be advanced past the printheads by a pair of rollers, at least one of the rollers driven by a drive system. The receiver medium may be single sheets or a continuous web. Advantageously in a web feed printer the printheads are pagewidth printheads that address the entire width of the web as it passes. Alternatively, if the printheads are partial pagewidth printheads the web is successively advanced and then held stationary while the printhead traverses the web to achieve full coverage.

The precise configuration of the inkjet printhead assemblies may vary as shown in FIG. 5-A and FIG. 5-B. In FIG. 5-A a printhead assembly 50 comprises process color individual printheads 54 and spot color individual printheads 56 mounted on a common assembly 50. The inkjet printhead assembly 50 is arranged peripheral to cylinder 52. In an alternative embodiment shown in FIG. 5-B the process, colors are mounted on a common inkjet printhead assembly 60, while spot colors are accommodated on a separate inkjet printhead assembly 62. Note that in the embodiment shown in FIG. 5-B the various printhead assemblies may share a common carriage mechanism for transport across the cylinder or they may have separate transport mechanisms. Furthermore, while the embodiments are shown with two spot colors, a particular printer may accommodate more or less that two spot colors.

There has thus been outlined the important features of the invention in order that it may be better understood, and in order that the present contribution to the art may be better appreciated. Those skilled in the art will appreciate that the conception on which this disclosure is based may readily be utilized as a basis for the design of other apparatus and methods for carrying out the several purposes of the invention. It is most important, therefore, that this disclosure be regarded as including such equivalent apparatus and methods as do not depart from the spirit and scope of the invention.

What is claimed is:

1. An inkjet printing apparatus for printing on a receiver medium using process colors and one or more spot colors, said apparatus comprising:

a) for a black process color, a first plurality of inkjet nozzles disposed on one or more individual printheads;

b) for each of the other process colors, a second plurality of inkjet nozzles disposed on one or more individual printheads;

c) for each spot color, a third plurality of inkjet nozzles disposed on one or more individual printheads, said third plurality less than said second plurality;

d) a media carrier for securing at least one said receiver medium and for generating relative motion between said receiver medium and said first, second and third pluralities of nozzles, said relative motion in a receiver medium advance direction.

2. The apparatus of claim 1 wherein said first plurality of nozzles and said second plurality of nozzles have the same number of nozzles.

3. The apparatus of claim 1 wherein said first plurality of nozzles is greater than said second plurality of nozzles.

4. The apparatus of claim 1 wherein said media carrier is a cylinder and said relative motion is provided by rotating said cylinder about a central axis.

5. The apparatus of claim 1 wherein said media carrier is a flatbed platen and said relative motion is provided by moving one of said flatbed platen, said receiver medium, or said first, second and third pluralities of nozzles.

6. The apparatus of claim 1 wherein said media carrier is a cylinder that engages only a portion of said receiver medium, said media carrier operative to move said receiver medium past said first, second and third pluralities of nozzles in said receiver medium advance direction.

7. The apparatus of claim 6 wherein said media carrier further comprises at least one pair of rollers, the rotation of at least one of said pair of rollers controlled by a drive system to move said receiver medium in said receiver medium advance direction.

8. The apparatus of claim 7 wherein said receiver medium is a continuous web.

9. The apparatus of claim 1 wherein said first and second pluralities of nozzles are disposed to form a pagewidth printhead assembly.

10. The apparatus of claim 9 wherein said first and second pluralities of nozzles are disposed to form a pagewidth printhead assembly able to print all dot tracks on said receiver medium in a single pass.

11. The apparatus of claim 9 wherein said third plurality of nozzles is disposed to form a pagewidth printhead assembly.

12. The apparatus of claim 11 wherein said third plurality of nozzles is disposed to form a pagewidth printhead assembly able to print all dot tracks on said receiver medium in a single pass.

13. The apparatus of claim 11 wherein said third plurality of nozzles have a larger nozzle-to-nozzle spacing than said second plurality of nozzles.

14. The apparatus of claim 11 wherein dots on the receiver medium produced by said third plurality of nozzles cover a larger area than dots on the receiver medium produced by said second plurality of nozzles.

15. The apparatus of claim 13 wherein dots on the receiver medium produced by said third plurality of nozzles cover a larger area than dots on the receiver medium produced by said second plurality of nozzles.

16. The apparatus of claim 9 wherein said third plurality of nozzles is disposed to form a partial pagewidth printhead assembly moveable in a scan direction, said scan direction substantially orthogonal to said receiver medium advance direction.

17. The apparatus of claim 16 wherein said third plurality of nozzles have a larger nozzle-to-nozzle spacing than said second plurality of nozzles.

18. The apparatus of claim 16 wherein dots on the receiver medium produced by said third plurality of nozzles cover a larger area than dots on the receiver medium produced by said second plurality of nozzles.

19. The apparatus of claim 17 wherein dots on the receiver medium produced by said third plurality of nozzles cover a larger area than dots on the receiver medium produced by said second plurality of nozzles.

20. The apparatus of claim 16 wherein said third plurality of nozzles has the same nozzle-to-nozzle spacing as said second plurality of nozzles.

21. The apparatus of claim 20 wherein said third plurality of nozzles print dot tracks on a receiver medium with a dot-to-dot spacing substantially the same as said second plurality of nozzles.

22. The apparatus of claim 21 wherein the printing rate for a receiver medium having one or more areas of spot color is lower than the printing rate for a receiver medium having no spot color areas.

23. The apparatus of claim 16 wherein said third plurality of nozzles print only a localized portion of the receiver medium, the remaining portion having no regions that require spot color printing.

24. The apparatus of claim 9 wherein said first, second and third pluralities of nozzles are supplied with ink from one or more reservoirs located proximate to said nozzles and attached to a common chassis with said nozzles.

25. The apparatus of claim 9 wherein said first, second and third pluralities of nozzles are supplied with ink via a conduit from one or more reservoirs that are located distal to said nozzles.

26. The apparatus of claim 9 wherein said first and second pluralities of nozzles are supplied with ink via a conduit from one or more reservoirs that are located distal to said first and second pluralities of nozzles and said third plurality of nozzles is supplied with ink from one or more reservoirs located proximate to said third plurality of nozzles and attached to a common chassis with said third plurality of nozzles.

27. The apparatus of claim 1 wherein said first and second pluralities of nozzles are disposed to form a partial page-width printhead assembly moveable in a scan direction substantially orthogonal to said receiver medium advance direction.

28. The apparatus of claim 27 wherein said third plurality of nozzles is disposed to form a partial pagewidth printhead assembly moveable in a scan direction substantially orthogonal to said receiver medium advance direction.

29. The apparatus of claim 28 wherein said movement in said scan direction for said first, second and third pluralities of nozzles is controlled by a common drive system.

30. The apparatus of claim 28 wherein said movement in said scan direction for said first and second pluralities of nozzles is controlled by a first drive system and said movement in said scan direction for said third plurality of nozzles is controlled by a second drive system.

31. The apparatus of claim 28 wherein said third plurality of nozzles have a larger nozzle-to-nozzle spacing than said second plurality of nozzles.

32. The apparatus of claim 28 wherein a dot on the receiver medium produced by each of said third plurality of nozzles covers a larger area than a dot produced by said second plurality of nozzles.

33. The apparatus of claim 31 wherein a dot on the receiver medium produced by each of said third plurality of nozzles covers a larger area than a dot produced by said second plurality of nozzles.

34. The apparatus of claim 28 wherein said third plurality of nozzles has the same nozzle-to-nozzle spacing as said second plurality of nozzles.

35. The apparatus of claim 34 wherein said third plurality of nozzles print dot tracks on a receiver medium with a dot-to-dot spacing substantially the same as said second plurality of nozzles.

36. The apparatus of claim 28 wherein said third plurality of nozzles print only a localized portion of the receiver medium, the remaining portion having no regions that require spot color printing.

37. The apparatus of claim 27 wherein said first, second and third pluralities of nozzles are supplied with ink from one or more reservoirs located proximate to said nozzles and attached to a common chassis with said nozzles.

38. The apparatus of claim 27 wherein said first, second and third pluralities of nozzles are supplied with ink via a conduit from one or more reservoirs that are located distal to said nozzles.

39. The apparatus of claim 27 wherein said first and second pluralities of nozzles are supplied with ink via a conduit from one or more reservoirs that are located distal to said first and second pluralities of nozzles and said third plurality of nozzles is supplied with ink from one or more reservoirs located proximate to said third plurality of nozzles and attached to a common chassis with said third plurality of nozzles.

40. A method of inkjet printing on a receiver medium using process colors and one or more spot colors, said method comprising steps of;

a) securing at least one said receiver medium on a media carrier;

b) printing a black process color using a first plurality of inkjet nozzles disposed on one or more individual printheads;

c) printing each of the other process colors using for each color a second plurality of inkjet nozzles disposed on one or more individual printheads;

d) printing each of said one or more spot colors using for each spot color a third plurality of inkjet nozzles disposed on one or more individual printheads, said third plurality less than said second plurality;

said printing performed while generating relative motion between said receiver medium and said first, second and third pluralities of nozzles.

* * * * *